United States Patent [19]

Suzuki et al.

[11] 4,333,807

[45] Jun. 8, 1982

[54] REVERSE COATING PROCESS

[75] Inventors: Tameyuki Suzuki, Zushi; Akira Kubo, Sakura, both of Japan

[73] Assignee: Shinto Paint Co., Ltd., Amagasaki, Japan

[21] Appl. No.: 192,839

[22] Filed: Oct. 1, 1980

[30] Foreign Application Priority Data

Oct. 12, 1979 [JP] Japan ..... 54-132257

[51] Int. Cl.[3] ..... C25D 13/06; C25D 13/20

[52] U.S. Cl. ..... 204/181 T

[58] Field of Search ..... 204/181 T

[56] References Cited

U.S. PATENT DOCUMENTS

| | | | |
|---|---|---|---|
| 3,404,079 | 10/1968 | Boardman | 204/181 T |
| 3,428,586 | 2/1969 | Coats | 204/181 T |
| 4,208,262 | 6/1980 | Kubo et al. | 204/181 T |
| 4,259,163 | 3/1981 | Suzuki et al. | 204/181 T |

*Primary Examiner*—Howard S. Williams

*Attorney, Agent, or Firm*—Wenderoth, Lind & Ponack

[57] ABSTRACT

The present invention relates to a reverse coating process which comprises coating a substrate with a first coating composition containing a fine synthetic resin powder which is solid at a room temperature but can be melted at an elevated temperature, heating the thus obtained coating, electrodeposition coating the coating with an ionic coating composition and subsequently heating the same, the improvement wherein the heating step following the first coating of the substrate with said resin powder-containing coating composition is carried out at a temperature which is high enough to melt the thus formed coating, but not so high to effect cross-linking curing of said coating, and wherein the coating, after said heating or electrodeposition coating step, is subjected to sanding, and the last heating step is carried out at a temperature which is high enough to effect a cross-linking cure reaction in the coating.

3 Claims, No Drawings

REVERSE COATING PROCESS

The present invention concerns an improvement in a reverse coating process and more specifically, it relates to a reverse coating process, comprising applying onto a substrate a resin powder-containing coating composition and subsequently an electrodeposition coat, and wherein the improvement involves the production of a coating having a good finish.

The so-called reverse coating process is a kind of prime coating method practically used in industries, mainly in the automobile body coating area. In making an under coat (including also a middle coat) on an automobile body, the heretofore used process comprises applying to the whole surface of the automobile body an electrodeposition coating with a cationic or anionic coating composition, and subsequently, carrying out, mainly at an outer portion of the body, a middle coating by using a conventional means (as, for example, spraying means). The reverse coating process comprises firstly applying mainly to the outer portion of the automobile body a resin powder-containing coating composition and then applying, only to the uncoated area, an electrodeposition coating, as a prime coating, with an ionic coating composition.

In this reverse coating process, if a good coating composition serviceable as both under coating and middle coating is applied to the outer portion of the automobile body, only one coating will suffice for the under coat and there is no need of adopting more coating operations (i.e. middle coating), two coating operations (under coat+top coat) are enough to obtain the desired end product. This is, of course, quite economical and contributive to the obtainment of an excellent coating film performance. Therefore, the so-called reverse coating process has become the object of public attention in these days.

In the first half coating step in a reverse coating process, use is made of a resin powder containing coating composition, which is quite desirable from the view point of its lower environmental disruption, its good workability in obtaining a thicker film, and its capability of exhibiting an excellent coating film characteristics. Examples of such powder coating compositions are dry resin powder coating compositions generally used in electrostatic resin powder coating, fluidized bed coatings or the like, resin powder electrodeposition coating compositions comprising fine synthetic resin powders uniformly dispersed in an aqueous ionic binder-resin solution, wet resin powder coating compositions (slurry coating composition) used in electrostatic or spray coating methods and the like. These coating compositions and their application methods each have merits and demerits, and however, they hold the characteristics of said powder coating composition in common. They each contain, as essential components, fine synthetic resin powders which are solid at a room temperature and can be melted when subjected to heating. After coating by an appropriate means, the thus applied coating composition is usually heated and melted to effect cross-linking cure to form the desired coating film.

Differing from the case of liquid coating composition, wherein use is made of the dilution with a solvent to make the composition flow and form a smooth coating film, the resin powder containing coating composition is heated to melt the solid resin and form the coating film. This involves such problems that it is prone to give insufficient flow of the coating film, thereby resulting in an orange peel or citron-like surface, which responds very sharply to the substrate conditions, thereby producing an unsatisfactory surface finish. Such imperfections may be eliminated by subjecting the cured film to a sanding operation. However, the resin powder containing coating composition generally gives a hard coat and therefore, such sanding requires a great number of manhours.

An object of the present invention is to obviate the abovementioned complicated sanding operation by making ingenious use of the steps of a reverse coating process and the characteristic properties of the resin powder containing coating.

The essential steps of the heretofore known reverse coating process (including resin powder coating) may be summarized as follows:

(a) Resin powder coating
(i) dry resin powder coating (electrostatic resin powder coating, fluidized bed coating)
(ii) resin powder electrodeposition coating
(iii) wet resin powder coating (slurry coating)
(b) Heating
(c) Electrodeposition coating
(d) Heating (cross-linking)

In the known reverse coating process, the heating step (b) is carried out so as to cause a cross-linking reaction, whereas in the present invention, the corresponding heating is carried out in a way that the applied composition is only melted, without being accompanied by a cross-linking reaction, to form a smooth coating film thereof.

A resin powder containing coating composition has such characteristic properties that when it is heated under certain conditions capable of melting the composition without causing a cross-linking reaction, and then cooled to a room temperature, a continuous smooth coating film can be obtained, which film is of less tacky and can be easily sanded at will. The thus formed film can be reflowed by the application of heat and when it is heated above certain critical temperatures, the so-called cross-linking reaction will occur at this stage.

The characteristic feature of the present invention resides in making use of the above mentioned thermal properties of the resin powder containing coating composition, to facilitate the sanding of the coating, which is a troublesome operation inevitable in the reverse coating process. That is, in the present invention, the first half heating is carefully controlled so as to give a continuous, smooth coating film of such a hardness as to bear up well against a typical sanding operation and yet which has film properties different than those of cross-linked, cured film because of the absence of such cross-linking. After the sanding operation, the coat is again heat-melted to make the surface smooth again. This second half heating is selected so as to give rise to a cross-linking reaction and form a final, cross-linked and cured coating film.

Thus, in the present invention, the thermal properties of the resin powder coating film and sanding operation are ingeniously coupled with a reverse coating process. That is, in the method of this invention, after forming the film of resin powder containing coating composition, (A) the thus applied coating film is heated at a temperature which is within the temperature range capable of giving a heat-melt of the resin powder coating film, but is below the critical temperature point in which a cross-linking reaction occurs in the film, or below the point at which some cross-linking may occur, but at such temperature as will not drastically alter the tackiness of the coating film and result in substantial changes in the re-melting properties of the film. (B) In the next place, the coating film is, before or after the electrodeposition coating with an ionic coating composition, subjected to sanding and (C) if not applied beforehand with the electrodeposition coating, the coating film is subjected to an electrodeposition coating at this stage. (D) Finally, the thus formed coating film is heated again to re-melt the coat and to result in a cross-linking cure thereof.

The present process will now be more fully explained, while making a comparison with the heretofore known reverse coating process. The abovesaid heating step (A) corresponds to the heating step (b) of the conventional reverse coating method. In this heating, it is preferred to use a hot air stream to obtain a uniform thermal distribution. As the heating conditions, it is necessary to melt the applied resin powder containing coating composition and form a continuous coating film, whose electric resistance is high enough to prevent electrodeposition on that portion thereof in the subsequent electrodeposition with an ionic coating composition, and furthermore, it is preferred to make the composition flow to such extent that a smooth and even surface is obtained so that a poorly conditioned portions can be easily detected. This heating is usually carried out, though somewhat varying with the kind of resin powder containing coating composition used and the shape and thickness of the substrate coated, by passing the coated article through a heated atmosphere maintained at 60° to 150° C. for 30 to 10 minutes.

The abovesaid step (B) may be put into operation at the stage between the steps (b) and (c) or between the steps (c) and (d) of the conventional reverse coating process. It is at the operator's will to select and determine the operational stage, and however, preference is given to the latter case. This is because, in that case, there are such advantages that (1) after electrodeposition coating (c), the coated material is usually washed with water, and therefore, in the successive sanding step, the so-called wet-sanding may be used and the last washing may be quite easily carried out, (2) after heating step (b), the coating film is, as is often the case with such film, possessed of water repellency and therefore, when the electrodeposited coating is washed with water, water drops remain on the coating film and at the end of the baking step (d), water marks are often produced thereon. These problems may be obviated by the adoption of sanding following the abovementioned washing operation. This sanding is usually carried out only at the necessary spots as, for example, the poorly conditioned portions resulted from the preceding operation, and, in some cases, sanding may be effected over the whole area of the coating to correct the orange peel or citron-like surface appearing thereupon. Any sanding material, including sand paper and sand cloth, may be used by hands or by machine as an air sander.

The processing step (D) corresponds to the heating step (d) of the conventional reverse coating process. This is put into operation, after finishing the optional preheating step mainly for water evaporation, as a baking step. Though the baking conditions vary somewhat with the type of resin powder containing coating composition, as well as the thickness and shape of the article to be coated, the general procedure is to pass the coated article through a hot air stoving oven at 170°-200° C. for 30 to 10 minutes.

As an ionic coating composition to be used in the present electrodeposition coating operation, either an anionic or cationic electrodeposition coating composition may be satisfactorily used.

According to the abovementioned present coating process, it is possible to carry out very easily and reasonably the correction of the poorly conditioned portions, which are liable to occur in a resin powder coating produced by the conventional reverse coating process. The invention shall be now more fully explained by Examples. Unless otherwise being stated, all parts and % in these Examples are by weight.

EXAMPLE 1

A resin powder coating composition was prepared as follows. According to the usual procedures for the manufacture of dry resin powder coating composition, 100 parts of epichlorohydrin-bisphenol type epoxy resin, melting point 94°-104° C., epoxy equivalent 875-975, molecular weight about 1400, 5 parts of adipic acid dihydrazide, 0.3 part of imidazole, 1.5 parts of levelling agent, 36 parts of titanium dioxide, and 4 parts of carbon black were mixed together, hot kneaded, cooled and pulverized to obtain a resin powder coating composition. The average grain size was 50 μm.

As an electrodeposition coating composition, use was made of an anionic electrodeposition coating composition containing a known polybutadiene resin binder. The used anionic electrodeposition bath was prepared as follows.

By using known procedures, an anionic resin comprising a polybutadiene resin, triethylamine as a neutralizer, and titanium oxide and carbon black as pigments were mixed together to form an electrodeposition bath. The characteristics of the bath were that it exhibited the following properties: pH 7.8; ash content 26%, and solid content 13%.

To the outer face of an automobile body previously treated with Bonderite No. 3118, and washed well with pure water and dried at 120° C. for 10 minutes, was applied a coating (dry thickness 40-50 μm) of the abovesaid resin powder-containing coating composition by using a Staget JR-50 type resin powder electrostatic coater (−80 KV). The thus coated automobile body was heated in a hot air stoving oven maintained at 100°-120° C., for 5 minutes. After cooling to a room temperature, was conducted a dry-sanding with sand paper over one half of the body portions where a particularly good surface finish is desirous, such as a roof, a bonnet, a trunk and the like. Before said sanding, the coating film showed an orange peel or citron-like fine surface in its entirety but had a good workability and was easily accessible to sanding. The thus sanded body was, after wiping, subjected to an electrodeposition coating. This electrodeposition was conducted under the following conditions: whole dipping; 200 V, 3 minutes; interelectrode distance (minimum) 40 cm. The composition was electrodeposited only on the area where no resin powder coating film was previously formed. After said electrodeposition coating, the article was washed with water, and air-blowed well to remove the remaining water droplets therefrom. Thereafter, the coating was baked in a stoving oven, heated at 180° C. for 30 minutes. It was found that a smooth surface was obtained at the sanded area and a top coat could be directly applied thereonto. However, the other half, non-sanded area showed an orange peel or citron-like surface and it was hard to apply a top coat thereon. This portion was dry-sanded then sand papered, but almost 3 times the number of manhours and abrasive material as used in the preceding sanding step were required.

EXAMPLE 2

A resin powder electrodeposition coating bath was prepared as follows: As a water dilutable cationic resin, a liquid amino-epoxy resin was prepared by reacting 488 parts of an epichlorohydrin-bisphenol type epoxy resin, of a melting point 64°-74° C., an epoxy equivalent of 450-550, a molecular weight of about 900, with 105 parts of diethanol amine and 250 parts of isopropyl alcohol at 80°-85° C. for 3 hours.

As a fine synthetic resin powder, 40 parts of an epichlorohydrin-bisphenol type epoxy resin, melting point 94°-104° C., epoxy equivalent 875-975, molecular weight about 1400, 30 parts of blocked isocyanate, 29 parts of titanium dioxide and 1 part of carbon black were hot kneaded in an extruder, and the extrudate was pulverized in an impact grinder to obtain the fine powder mainly of epoxy resin with an average diameter of 7 μm.

To 143 parts of the abovesaid cationic resin (as binder), were added 6.2 parts of glacial acetic acid and 500 parts of deionized water, and the mixture was stirred well in a dissolver. Thereafter, 280 parts of the abovementioned fine synthetic resin powder were added to and the mixture was stirred in the dissolver for 30 minutes, which was then diluted with deionized water until the solid content became 15%. The characteristics of the thus obtained bath were pH 5.2 and Po/-Bi=2.8/1.

A cationic electrodeposition bath was prepared as follows:

A mixture of 336 parts of an epichlorohydrin-bisphenol type epoxy resin, melting point 94°-104° C., epoxy equivalent 875-975, molecular weight about 1400, 143 parts of epichlorohydrin-bisphenol type epoxy resin, melting point 64°-74° C., epoxy equivalent 450-550, molecular weight about 900, and 140 parts of Ethyl Cellosolve were stirred well to give a complete solution. After heating to 50° C., a solution of 59 parts of diethanol amine in 20 parts of isopropyl alcohol was added, while stirring for over 1 hour, and thereafter, the mixture was maintained at 80°-85° C. for 3 hours. To this mixture, a solution of 202 parts of blocked isocyanate in 100 parts of Ethyl Cellosolve was, while stirring, and was added over 30 minutes, and the thus obtained mixture was maintained at 80° to 85° C. for an additional 1.5 hours to obtain an aminoepoxy isocyanate resin.

Following the usual procedure for the preparation of an electrodeposition coating composition, the abovesaid cationic resin was combined with acetic acid (as neutralizer) and titanium oxide and carbon black (as pigments), and the thus obtained mixture was diluted with pure water to a defined concentration to obtain a cationic electrodeposition bath, whose characteristics were such as to exhibit the following properties: pH 5.4, ash content 25% and solid content 13%.

To an automobile body previously treated with Bonderite No. 3118, washed well with pure water and dried at 120° C. for 10 minutes, was applied a coating by using the abovesaid resin powder electrodeposition coating bath. The coating conditions were: voltage 400 V; current supplying time 30 seconds; bath temperature 27° C.; interelectrode distance (min.) 40 cm; area ratio of outer-plate portion of automobile body to counter electrode=about 1:1.

After taking the automobile body out of the bath, it was washed well with water and dried in a hot air stoving oven at 90° C. for 10 minutes. The thus obtained coating film had, in its entirety, a brilliant, orange peel or citron-like fine surface and was of easy workability.

After cooling to a room temperature, this body was fully dipped into the cationic electrodeposition bath and electrodeposition was carried out under the following conditions: voltage 250 V; current supplying time 3 minutes; bath temperature 28° C.; and interelectrode distance (min.) 40 cm. Thereafter, the automobile body was washed with water, and only one half of the portions where excellent top coat appearance was desirable for use, e.g., as a roof, bonnet, trunk cover and the like were wet sanded with sand paper. After washing well with water, the automobile body was dried in an atmosphere maintained at 100° C. for 10 minutes, and then baked in an atmosphere maintained at 190° C. for 20 minutes.

The wet sanded portions showed a smooth coating surface, on which a top coat could be directly applied. However, the other untreated half showed a poor conditioned, uneven surface, which required almost twice the number of manhours and abrasive material for effecting wet sanding, as compared with those of the preceding wet sanding operation.

EXAMPLE 3

The same binder as used in Example 2 was diluted with water to give a dilution of 15% solid content, and to this, was added the same resin powder as used in Example 2, while controlling the viscosity of the mixture with water, to give a slurry having a solid ratio of said binder to powder of 1:3. The viscosity of the slurry was again adjusted with water to a Ford cup No. 4 viscosity of 30 sec./25° C. to obtain the test resin powder containing coating composition.

The abovesaid slurry coating composition was, using wider No. 61 type spray gun (Iwata Coater Co.), applied to one surface of a square (50×50 cm) substrate previously treated with Bonderite No. 3004, so as to give a dry film thickness of 40 to 50 μm, and thereafter, the coated article was dried in an atmosphere of 110° C. for 10 minutes. The coating showed, in its entirety, a fine, orange peel or citron-like surface. Thereafter, this plate was subjected to an electrodeposition coating with the same cationic electrodeposition bath as used in Example 2 (200 V, 2 minutes, 25° C.), and washed well with water. One half of the coated surface was then wet sanded by means of an air sander with a nylon sand cloth, to the extent that almost one third of the raised portion of said orange peel or citron-like surface was scraped off. After washing with water and wiping the remained droplets off, it was pre-heated at 100° C. for 10 minutes and then baked at 180° C. for 20 minutes.

The sanded portion gained a smooth surface, to which a top coat could be directly applied, but the non-sanded portion showed an orange peel or citron-like surface, which was unable to be coated with a top coat as it was. This latter portion was sanded with the same abrasive material and the same air-sander as used in the abovesaid sanding, but in order to obtain a good finish with the top coat, almost 4 times the number of manhours and sanding material were required.

What we claim is:

1. In a reverse coating process comprising coating a substrate with a coating composition containing a fine synthetic resin powder which is solid at a room temperature but can be melted at an elevated temperature, heating the thus-obtained coating, electrodeposition coating the first coating with an ionic coating composition and subsequently heating the same, the improvement wherein the heating step following the first coating of the substrate with said resin powder-containing coating composition is carried out at a temperature which is high enough to completely melt the thus-formed coating but not so high to effect cross-linking curing of said coating, and wherein the coating, after the said heating or the electrodeposition coating step, is subjected to sanding, and the last heating step is carried out at a temperature which is high enough to effect a cross-linking cure reaction in the coating.

2. A process as claimed in claim 1 wherein the first heating is conducted at a temperature of from 60° to 150° C. for 10 to 30 minutes.

3. A process as claimed in claim 1 wherein the last heating is conducted at a temperature of from 170° to 200° C. for 10–30 minutes.

* * * * *